US005881127A

United States Patent [19]

Molloi et al.

[11] Patent Number: 5,881,127

[45] Date of Patent: Mar. 9, 1999

[54] AUTOMATIC X-RAY BEAM EQUALIZER

[75] Inventors: Sabee Molloi, Laguna Beach; Jerry Tang, Irvine, both of Calif.

[73] Assignee: The Regents of the University of California, Oakland, Calif.

[21] Appl. No.: 921,994

[22] Filed: Aug. 27, 1997

(Under 37 CFR 1.47)

Related U.S. Application Data

[63] Continuation-in-part of Ser. No. 588,814, Jan. 19, 1996, Pat. No. 5,778,046.

[51] Int. Cl.[6] ..... G21K 3/00

[52] U.S. Cl. ..... 378/159; 378/156

[58] Field of Search ..... 378/156–159

[56] References Cited

PUBLICATIONS

Peppler et al "Digitally Controlled Beam Actuator", SPIE 37:106–111 (1982).

*Primary Examiner*—Craig E. Church
*Attorney, Agent, or Firm*—Medlen & Carroll, LLP

[57] ABSTRACT

The present invention provides for an improved automatic x-ray beam equalizer. By analyzing an initial low dosage x-ray image of an object, an attenuation pattern can be calculated. An equalization pattern, generated from the attenuation pattern, can then be created in a mask and placed in the path of a full x-ray beam scan using a stepper motor assembly in order to properly attenuate the x-ray signal and create a clearer x-ray image of the object.

21 Claims, 9 Drawing Sheets

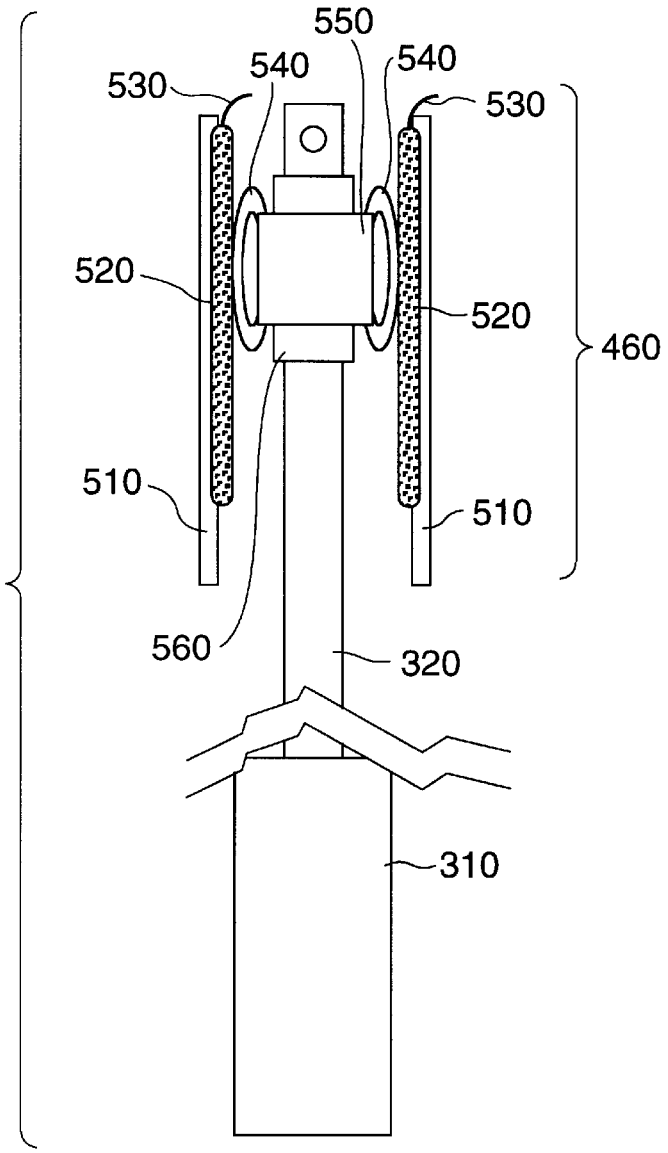
FIG. 5.1
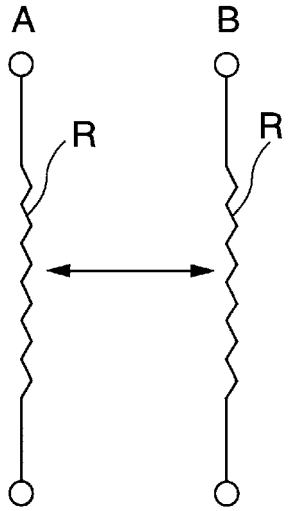
FIG. 5.2

AUTOMATIC X-RAY BEAM EQUALIZER

The present application is a continuation-in-part of application Ser. No. 08/588,814 filed on Jan. 19, 1996 now U.S. Pat. No. 5,778,046.

This invention was made with Government support under Grant Nos. R29-HL42435 and R01-HL48030, awarded by the National Institutes of Health. The Government has certain rights in this invention.

FIELD OF THE INVENTION

This invention relates to the field of x-ray radiography. More particularly, this invention relates to equalization techniques for radiographic and fluoroscopic diagnostic x-ray systems.

BACKGROUND OF THE INVENTION

In conventional radiography, image quality and diagnostic value can be compromised when the object density differs drastically between different parts of an object. For example, in conventional chest x-rays the mediastinum and retrocardiac area can be underexposed, detracting from the diagnostic value of the image. In fact, many diagnostic errors in chest radiography occur in areas displayed with suboptimal contrast or penetration. Missed lung metastases, for example, can reside in these underexposed areas, camouflaged from view.

Equalization is a common term in the x-ray radiography field which refers to the process of selectively attenuating certain portions of the patient or object exposed to the x-ray. An x-ray radiographic image can be equalized by selectively attenuating only those areas of the image that are determined to have been overexposed. The effect of equalization is to reduce the intrinsically large dynamic range of the x-ray beam intensities in order to accommodate the dynamic range limitations of most x-ray detector systems. The most common detector systems employed in diagnostic x-ray radiography are film and image intensifier-TV systems, both of which have severely limited dynamic ranges.

Different methods have been presented to correct the problems described above. For example, one method involves arranging a plurality of filters between an x-ray emitter and the image receptor. The filters are selected and arranged so that only the areas of over-exposure are attenuated. Practice of this method provides acceptable results, once the correct combination of filters are found. However, a serious drawback of this method is that it is cumbersome since filter selection and juxtaposition is a manual process and can require time consuming trial and error for the correct combination to be found.

Another approach for addressing the above-described problem involves variably attenuating different portions of an x-ray beam by placing an attenuating material between an x-ray source and a patient. For example, one method is described in Peppler, et al., "Digitally Controlled Beam Attenuator," SPIE, 347:106–111, 1982. Peppler describes a digital beam attenuating device for attenuating specific areas of an imaged object. The device consists of an attenuation chamber which is placed between the x-ray tube and the patient. The chamber consists of a 6×6 array of 1 cm square lucite pistons each with a 1 cm stroke. An attenuating material of cerium chloride ($CeCl_3$) in solution is housed within a shapable latex membrane and placed in the path of the x-ray beam between the x-ray tube and the patient. A computer controls the advancement of the pistons which press into the membrane, adjusting the thickness of the $CeCl_3$ at certain cells. The degree of attenuation depends on the thickness of the $CeCl_3$. A solenoid controls water lines which control the advancement and retreat of the pistons. A reservoir is coupled to the latex membrane to catch overflowing solution when the membrane is compressed.

The most critical limitation with Peppler is that the empty digital beam attenuator reduces the primary x-ray attenuation by a factor of 15, which creates severe tube loading problems. Furthermore, Peppler utilizes a large number of dynamic elements such as the water lines and solenoids. These increase the chances of breakdowns, thereby increasing the costs of maintenance.

Another method is described in U.S. Pat. No. 4,497,062 to Mistretta (and a corresponding article: Hasegawa, B. H., Dobbins III, J. T., et al., "Feasibility of Selective Exposure Radiography," SPIE, 454:271–278, 1984). Mistretta describes a digitally-controlled x-ray beam method and apparatus. The apparatus comprises a computer which analyzes an initial x-ray image to locate high and low gray level regions. Based on this determination, an attenuation number for each pixel in the image is assigned and transmitted to a printer; such as a dot matrix or ink jet printer. A non-attenuating substrate is fed through the printer while the printer prints an attenuating pattern onto the substrate. The "ink" present on the ribbon contains attenuating material such as cerium oxide. The printer deposits the attenuating cerium in varying thicknesses depending on the attenuation number. The substrate is then placed between the x-ray source and the patient during a subsequent regular x-ray.

A major limitation of the technique proposed by Mistretta is the relatively long time required for custom fabrication of the compensation filter that precluded its clinical implementation. Specifically, it is described that the printing time of 80 layers of a 64×64 pixel attenuator, as of the publication date of the article, was less than 30 minutes. It was hoped that by increasing the number of print heads and by using faster repetition rates, the time could be reduced to 30 seconds. This is still not acceptable for clinical applications because a patient must remain absolutely still between the time the initial scan is performed, during the creation of the attenuator, and through the final scan. If the patient was to move, even slightly, the attenuation pattern would change and the image would not be properly attenuated.

What is needed is a simple device that can variably attenuate different regions of an x-ray signal in order to provide a clearer x-ray image of an object having variable densities.

SUMMARY

In accordance with the invention, x-ray equalization masks are prepared rapidly and economically from a first exposure of a patient, or other x-ray target object, to a beam of x-rays which, after passing through the patient, is received by an x-ray detector such as an electronic image receptor. The x-ray detector provides an output signal containing data indicating the intensity of the x-rays at all positions in the image field. This data is converted by an image processor such as a computer, wherein the intensity of the x-ray beam passing through the object or patient and striking the electronic image receptor is measured within a plurality of sub-fields (which the image field is divided into), which cover the desired image field in a two dimensional array. This information is used by the processor to determine attenuation values for each of the different pixels in the array. The attenuation values are the amount of attenuation needed to compensate for the different object or patient densities in order to create a clearer image. The processor then controls a shaping means which forms an equalization pattern in a mask. The mask is placed close to the focal spot of the x-ray beam before the acquisition of the equalized image.

The present invention comprises a processor for determining an attenuation pattern; a shaping means under control of the processor; and an equalization mask wherein said mask is pressed against said shaping means to form an equalization pattern, and placed in a path of the x-ray beam between the x-ray source and the object, such that the x-ray beam is attenuated and a clearer x-ray image is generated.

In one embodiment the shaping means of the present invention comprises an interface means coupled to said processor, a plurality of actuators coupled to said interface means, and an array of pistons for shaping the mask. In a preferred embodiment, the plurality of actuators comprises a plurality of nickel-titanium wires, each of said plurality of wires for receiving a specific current and lengthening in response to said current. In this embodiment, the pistons are coupled to the wires so that as said wires lengthen, specific pistons advance a predetermined distance.

In an alternative and preferred embodiment of the shaping means, the interface means comprises a motor controller, and the plurality of actuators comprises a stepper motor assembly which is used to control the displacement of the pistons in the array. In a further embodiment, the stepper motor assembly is coupled to the array of pistons by means of conduits. In a still further embodiment, the conduits comprise flexible shafts disposed inside of extension springs.

In one embodiment, the rotational motion of the stepper motors is converted to linear displacement of the pistons by means of a lead screw attached to each stepper motor, a nut threaded on said lead screw and secured by an alignment rod to at least one plate, and a flexible shaft coupled between said nut and one of said pistons.

In one embodiment, the stepper motor assembly comprises a series of piston stepper motors. In a further embodiment, the series of piston stepper motors are used to displace a single row of pistons in the array at one time, and are moved sequentially between said rows by means of a separate X-axis stepper motor. In an alternative embodiment, the array of pistons further comprises a matrix of active pistons, surrounded by additional pistons for reshaping the mask to a uniform thickness.

The present invention further comprises a positioning system for supporting the equalization mask while the equalization pattern is being generated, and for manipulating the mask between a position outside the x-ray beam path and a position within the x-ray beam path. In a preferred embodiment, the positioning system comprises a Z-axis stepper motor and an X'-axis stepper motor.

The present invention also provides a method for attenuating an x-ray beam in order to provide a clearer x-ray image of an object having variable densities. The method comprises the steps of providing an x-ray source, an x-ray detector, an object, a processor, a stepper motor assembly under control of the processor and coupled to an array of pistons, and a mask; obtaining an initial image of said object; calculating an appropriate attenuation pattern based on said initial image with said processor; forming an appropriate equalization pattern in said mask by i) advancing select pistons in said array of pistons with said stepper motor assembly under control of said processor, and ii) pressing said array of pistons against said mask in order to create said equalization pattern in said mask; and placing said mask in a path of said x-ray beam between the x-ray source and the patient, such that the beam is attenuated.

In a preferred embodiment, the step of calculating the attenuation pattern further comprises the steps of locating different regions of exposure in the initial image; and calculating thicknesses of said mask required to attenuate said different regions of exposure.

It is not intended that the present invention be limited to the precise composition of the equalization mask. In one embodiment, the equalization mask is comprised of a binding material and a rare earth metal. In a preferred embodiment, the binding material is silicone rubber and the rare earth metal is cerium oxide.

BRIEF DESCRIPTION OF THE FIGURES

FIG. 5-1 illustrates a preferred embodiment of the actuation potentiometer utilized in the piston positioning mechanism shown in FIG. 4.

FIG. 5-2 illustrates the effective circuit of the potentiometer illustrated in FIG. 5-1.

GENERAL DESCRIPTION OF THE PRESENT INVENTION

Figure 1:
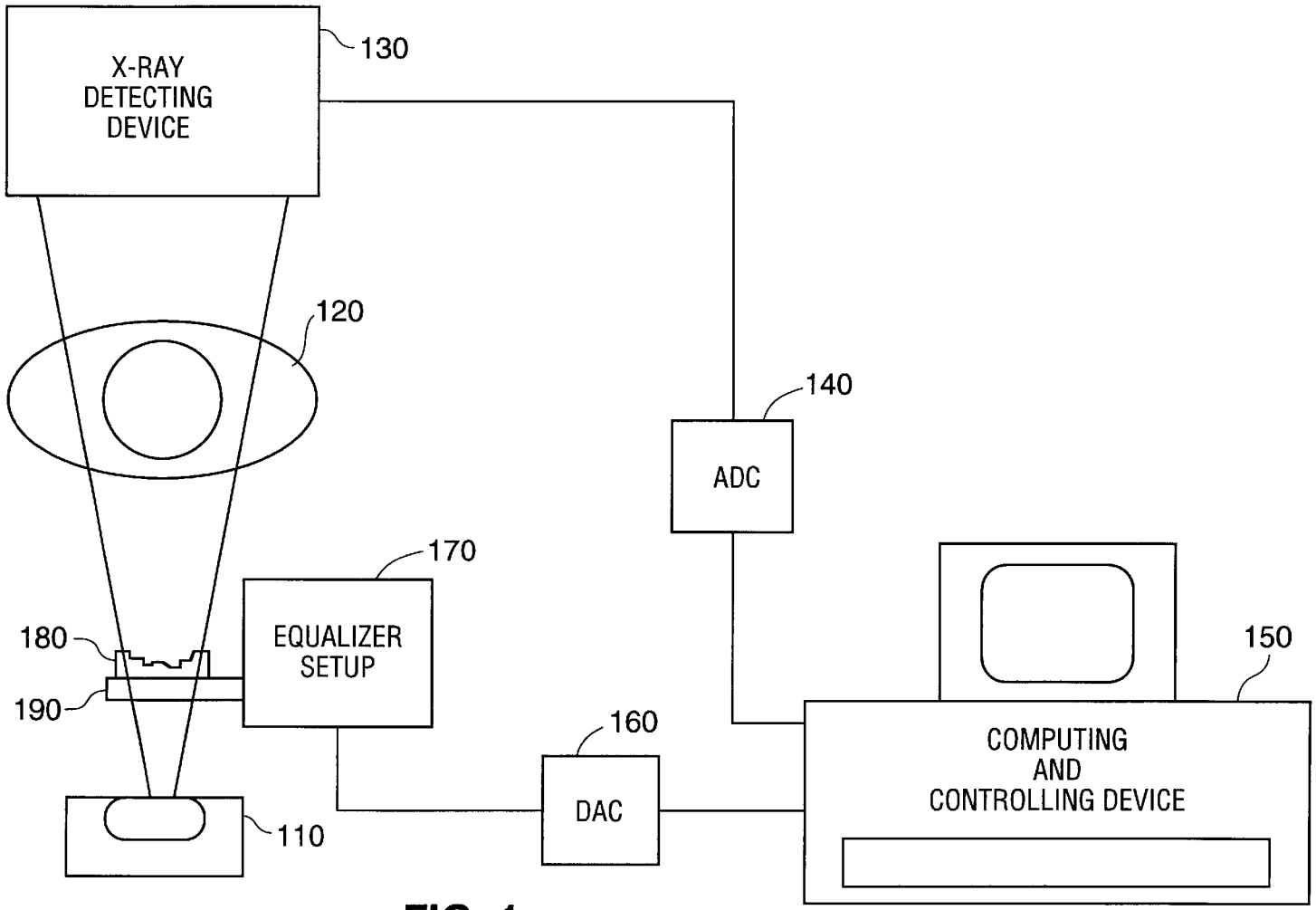
FIG. 1 is a block diagram illustrating the basic elements in a preferred embodiment of the x-ray beam equalization apparatus according to the present invention.

The present invention provides an apparatus that can variably attenuate different regions of an x-ray signal, in order to compensate for varying densities in objects such as a human chest cavity. While the preferred embodiment described herein is directed generally toward chest radiography, it is contemplated that the present invention will have broad application in many x-ray projection modalities, including mammography, x-ray angiography and fluoroscopy, and can be advantageously used to provide a clearer x-ray image of virtually any object having variable densities.

For work with patients, an initial pre-exposure image of the patient is taken in order to determine the effect of the patient's internal organs and structures on the x-ray image. A computer coupled to the x-ray detector processes the image and locates regions of high and low exposure. Based on this information, the computer is able to determine the appropriate attenuation pattern required to create a clearer image. The computer controls the advancement of select pistons in a matrix of active pistons, typically an 8×8 or 16×16 array, based on the attenuation pattern.

In one embodiment, the computer is coupled through an interface means to nickel-titanium wires, which are used to actuate the piston array. The interface means can be any suitable electrical connection (i.e. wires or cables) allowing current to flow between the computer and the nickel-titanium wires. Nickel-titanium wires are unique in that they respond to applied currents by changing their lengths. The greater the current or temperature, the shorter the wires become. In a preferred embodiment, the wires are coupled through a spring system (illustrated in FIG. 4) to the matrix of pistons, so that when the current is removed from the wires, the wires will stretch to their original length. The computer is able to control the advancement of the individual pistons by controlling the transmission of current to the wires.

Once the pistons have been advanced, they are pressed against a blank mask of binding material and a highly attenuating compound. (The mask could alternatively be pressed against the pistons.) This forms an equalization pattern in the mask. The mask is then placed approximately at the focal point of a regular x-ray beam in order to properly attenuate the beam. The equalization mask is formed so that thicker regions correspond to previously high exposure regions and thinner regions correspond to previously low exposure regions. It is contemplated that the entire process will take approximately 5 seconds or less, since it is imperative that the patient remain still during the process. If the patient moves between the short time of the initial low exposure x-ray and final regular x-ray, the attenuation pattern will be inaccurate and the resultant image will not be improved and will likely be degraded (i.e. have artifacts). The present invention considerably improves upon the prior art by drastically reducing the time factor.

In an alternative embodiment of the actuation mechanism, the piston displacement is accomplished by means of a series of stepper motors. In a preferred embodiment of the stepper motor mechanism, the rotational motion of each motor is converted into a linear motion by attaching a lead screw and nut to the shaft of the motor, and a small flexible shaft is used to simultaneously push one row of pistons into the attenuating mask. In a further embodiment, another stepper motor assembly is attached to the row of flexible shafts and used to sequentially position the flexible shafts to the next row of pistons in the array. This process is repeated until all of the pistons in the array have been pushed the desired distance into the attenuating mask. In a still further embodiment, the mask is separated from the pistons and moved into a pre-determined position in the x-ray beam using yet another stepper motor assembly.

In addition to its disclosed utility in diagnostic radiology, the x-ray beam equalization invention described and claimed herein provides several additional diagnostic and therapeutic uses. For example, region of interest fluoroscopy has been proposed as an alternative technique for reducing the x-ray dose to both patients and operators during a fluoroscopic procedure, and to improve contrast in the region of interest. See, e.g., Rudin et al., *Med. Phys.* 19(5):1183–9 (1992); Labbe et al., *Med. Phys.* 21(3):471–81 (1994). However, the devices utilized in these prior art disclosures are limited to a single circular copper filter of particular thickness, which is positioned at the center of the x-ray beam, which severely limits the adaptability of the technique. The x-ray beam equalization device of the present invention provides a significant improvement over the prior art, since it can be used to generate a region of interest with virtually any desired arbitrary shape and attenuation. Thus, the operator can determine the size and shape of the region of interest for each patient according to the clinical need.

It is contemplated that the present invention will also find advantageous use in the technique of conformal radiotherapy. This technique has been investigated as a means of improving the ratio of target dose to normal tissue dose, thereby improving the probability of uncomplicated local tumor control. See, e.g., Verhey, *Front. Radiat. Ther. Oncol.* 29:139–55 (1996). The incorporation of the present invention into this technique will provide several important advantages over the existing prior art methods and devices. First, the use of the present invention will allow for the production of complicated dose distributions. Second, with the present invention the appropriate radiation dose can be delivered non-uniformly in a short time interval. In addition, portal imaging can be used to verify dose delivery before treatment is started. Finally, the apparatus of the present invention can be easily implemented into existing systems with little or no modifications necessary for the linear accelerator.

Other and further objects, features, advantages and embodiments of the present invention will become apparent to one skilled in the art from reading the detailed description of the invention together with the drawings.

DETAILED DESCRIPTION OF THE PREFERRED EMBODIMENT

The following description serves to illustrate certain preferred embodiments and various practical aspects of the present invention and is not to be construed as limiting the scope thereof.

In considering the automatic x-ray beam equalizer of the present invention some definitions are helpful. For example, "attenuation" denotes a decrease in signal intensity, in this case, x-ray beam intensity. A "shaping means" denotes any means for altering the shape of the equalization mask. By way of example only, the following disclosure utilizes an array of pistons and associated circuitry to shape the equalization mask. An "active" piston denotes a piston in the array which is utilized to form the equalization pattern in the mask. In one embodiment, an "equalization mask" is comprised of at least one highly attenuating compound (i.e. a rare earth metal which has the property of being able to attenuate an x-ray photon). The preferred equalization mask further comprises a suitable binding compound, such as clay).

An "attenuation pattern" is a specific pattern of lengths each piston in the array of pistons must be advanced, in order to create an appropriate equalization pattern to attenuate an x-ray beam for optimal contrast and clarity. The attenuation pattern is determined by analyzing high and low exposure regions of the initial pre-exposure x-ray image. An "equalization pattern" is the result after the equalization mask has been positioned (e.g pressed) against the pistons, or vice-versa, so as to form an appropriate shape for attenuating an x-ray beam.

FIG. 1 shows a block diagram of the preferred x-ray beam equalization apparatus according to the present invention. This embodiment comprises an x-ray tube 110, a patient or object 120, an x-ray detecting device 130, an analog-to-digital conversion (ADC) interface 140, a computing device 150, a digital-to-analog conversion (DAC) interface 160, the equalizer setup 170, and the equalization mask 180 made of attenuating materials. The equalizer setup 170 comprises those elements necessary for creating the equalization pattern in the equalization mask. The preferred equalizer setup 170 includes an array of pistons and those elements necessary for advancing these pistons (see FIGS. 3 and 7 and corresponding descriptions), as well as a suitable means for supporting and moving the equalization mask 180, such as a sliding tray 190.

As an initial step, a low-dose unequalized (uncompensated) image of the object 120 is acquired by the x-ray detecting device 130, without the equalization mask 180 in the x-ray beam path. This pre-exposure image represents a less than optimal image, which is intended to illustrate the areas that require attenuation in order to generate a clearer image. The image information is digitized, if necessary, using an ADC interface 140, and is then transferred to the computing device 150 in a digital format. The present invention contemplates that the image data can be obtained in either analog or digital format. In a preferred embodiment, a frame grabber with digital acquisition capability, such as a Matrox Pulsar, is interfaced directly with a Pentium™ computer.

The image information is converted, within the computing device 150, into digital controlling signals which correspond to the required piston displacement to achieve the appropriate attenuating material thickness. The signal is then converted to analog format, using a DAC interface 160, and is transferred to the equalizer setup circuitry 170. The equalizer set-up 170 then adjusts the positions of pistons 310 (as shown in FIGS. 4 and 7), pressing them into the attenuating material to generate a depth pattern on the equalization mask 180. The depth pattern is formed so that thicker regions correspond to previously high exposure regions and thinner regions correspond to previously low exposure regions. Finally, the equalization mask 180 is positioned in the x-ray field and the equalized image is acquired. The details of this process are shown in FIGS. 2–8.

Figure 2:
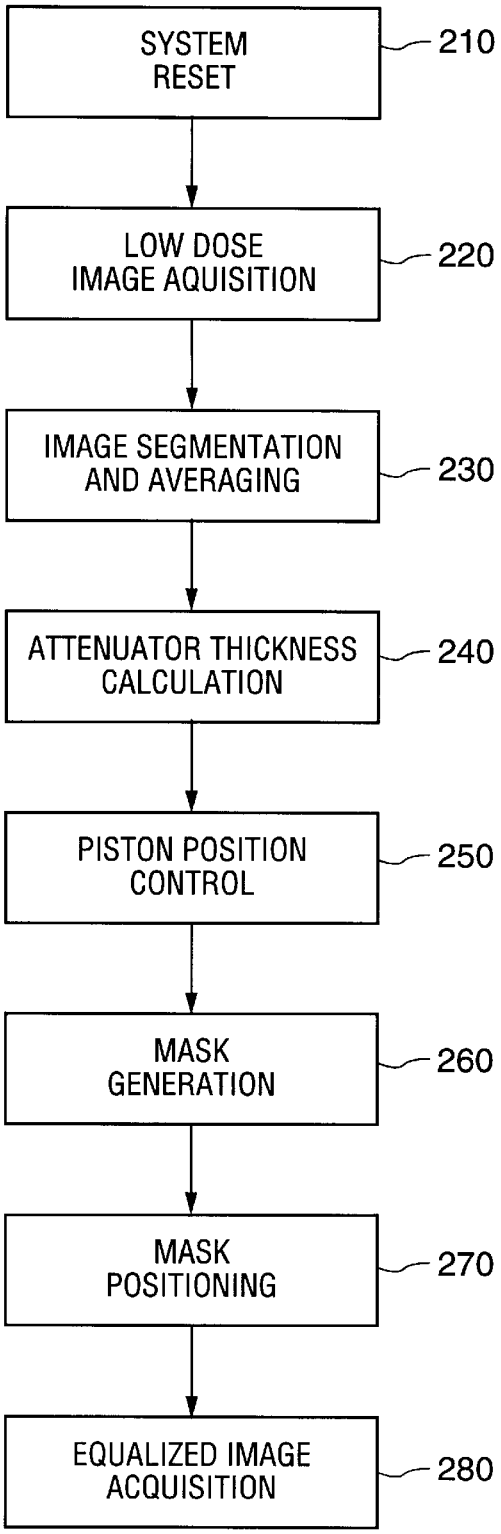
FIG. 2 is a flow chart demonstrating a preferred embodiment of the x-ray beam equalization process according to the present invention.

FIG. 2 shows a flow chart for the x-ray beam equalization process. At the beginning of image acquisition, a system reset 210 is performed to ensure that the attenuating material (mask) is set to a uniform thickness. In one embodiment, this can be accomplished by advancing all of the pistons to a uniform length and pressing the attenuating material against the pistons such that the entire mask is of an even thickness. A low-dose pre-exposure image is then acquired 220 with the equalization mask out of the x-ray field. The calculation scheme first includes an image segmentation and averaging process 230 which divides the initial uncompensated image into a matrix of square regions and finds the average gray level within each square region. The size of each region is obtained by dividing the image field size by the total number of pistons in the field. The averaged gray level information for each square region of the image is then used to calculate the required piston displacement or attenuator thickness 240. The details of the attenuator thickness determination using the average gray level for each square piston are discussed in more detail below.

The calculated thickness information is then converted by the DAC interface 160 (see FIG. 1) into analog signals and is transferred to the piston position control 250 (see FIG. 2) which is an element of the equalizer setup 170 (see FIG. 1). After the piston positions are set according to the average gray levels, mask generation 260 (see FIG. 2) is then initiated. This is done by pressing the uniform attenuating material against the appropriately positioned pistons. The mask is then positioned into the x-ray field, using the mask positioning system 270 (a further element of the equalizer setup 170), before the acquisition of equalized image 280. It is contemplated that the mask positioning system 270 can be any conventional electro-mechanical device for moving the equalization mask into and out of the x-ray beam path (e.g. a sliding tray or a stepper motor apparatus).

Mask Thickness Determination

Average image gray level is used for determination of the desired piston position or attenuator thickness. In an ideal condition, the relationship between incident, $I_o$, and transmitted, I, intensity through an attenuating mask can be written as:

$$I=I_o e^{-\mu_m^{eff} t_m} \tag{1}$$

Where $t_m$ is the attenuator thickness and $\mu^{eff}_m$ is the effective linear attenuation coefficient of the attenuating mask.

The attenuator thickness can be calculated using equation 1:

$$t_m = \frac{\ln\left(\frac{I_o}{I}\right)}{\mu_m^{eff}} \tag{2}$$

In the above equation, $t_m$ is the required attenuator thickness to compensate for a certain gray level I to the desired gray level $I_{min}$. The value can be measured at a particular beam energy using a calibration phantom with different thicknesses of the attenuating material. A calibration phantom is a calibration device that incorporates attenuating material of different thicknesses. It is used to determine the amount of attenuation that different thicknesses of the attenuating material will generate.

The attenuating mask 180 can be made by mixing a deformable binding material. In the preferred embodiment, this binding material is silicone rubber (Depco Inc. Silicone Rubber packing Hauppauge, N.Y. ) with cerium oxide ($CeO_2$). A 1 cm thickness of a mixture of 15 g of $CeO_2$ with 55 $cm^3$ of silicone rubber produces a dynamic range of 10 in a 65 kVp image (where kVp is the peak x-ray tube potential). In other words, this concentration of mask requires a piston travel of 1 cm in order to compensate for a dynamic range of 10 in an image. Depending on the intended application, other x-ray attenuating materials can also be used. The choice of the x-ray attenuating material is determined by its effect on the x-ray spectrum.

In the computing and controlling device 150 the dynamic range, D, is calculated using the following formula:

$$D=I_{max}/I_{min} \tag{3}$$

Where $I_{max}$ and $I_{min}$ are the maximum and minimum average pixel values in the image.

The above operations can be performed using a look-up table where the average gray level is used as an input and the output value is proportional to the attenuator thickness for each piston location. The attenuator thickness data, corresponding to the appropriate piston displacement, is then passed on to the equalizer setup 170, which actuates the pistons to the correct position for mask generation.

Piston Displacement Using Nickel-Titanium Wires

In one embodiment of the equalizer setup 170, illustrated in FIGS. 3–6, the computer is coupled through an interface means to nickel-titanium wires, which are used to actuate the piston array. The greater the current or temperature, the shorter the wires become. Thus, the computer is able to control the advancement of individual pistons by controlling the transmission of current through the wires.

Figure 3:
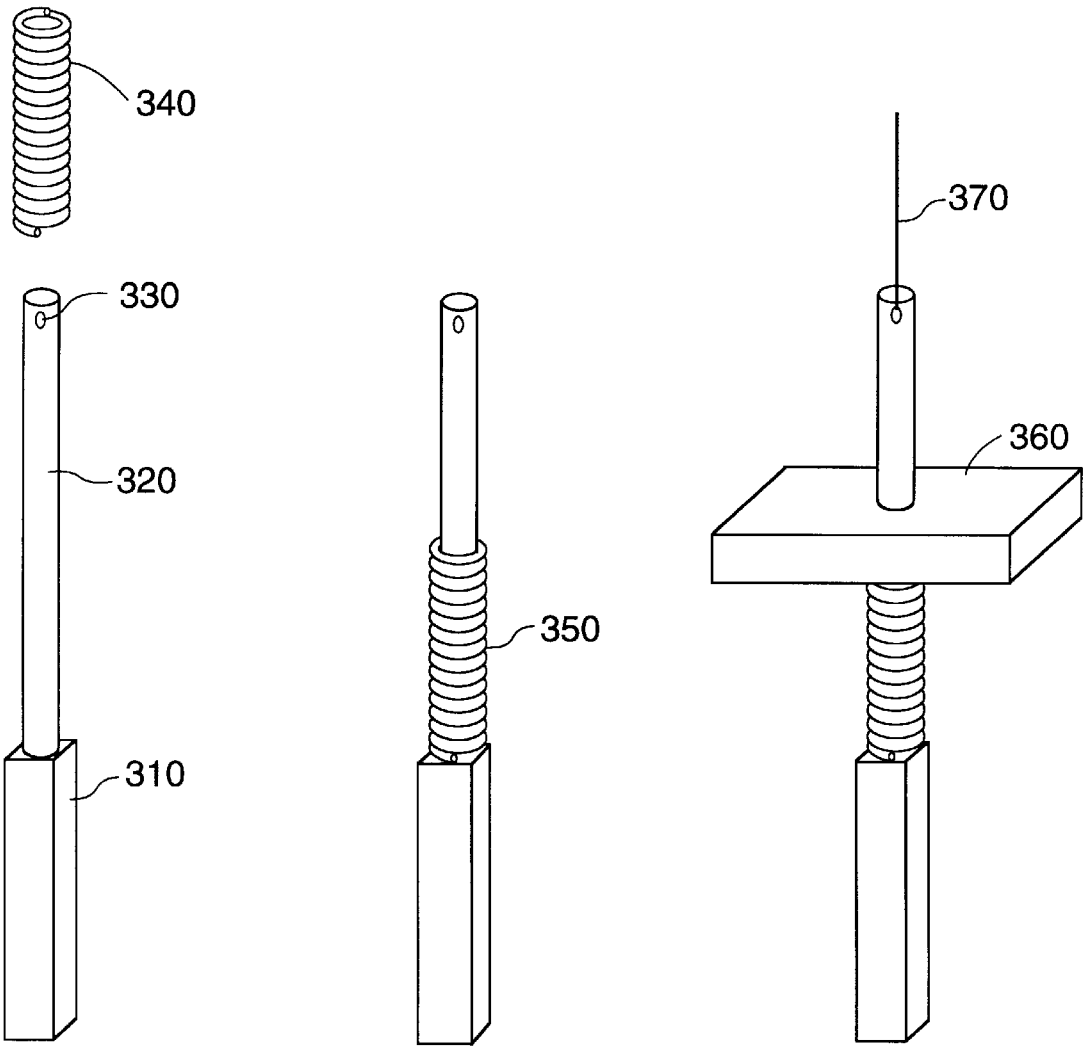
FIG. 3 illustrates a preferred embodiment of the pistons utilized in the equalizer setup employing nickel-titanium wires for piston displacement.
Figure 4:
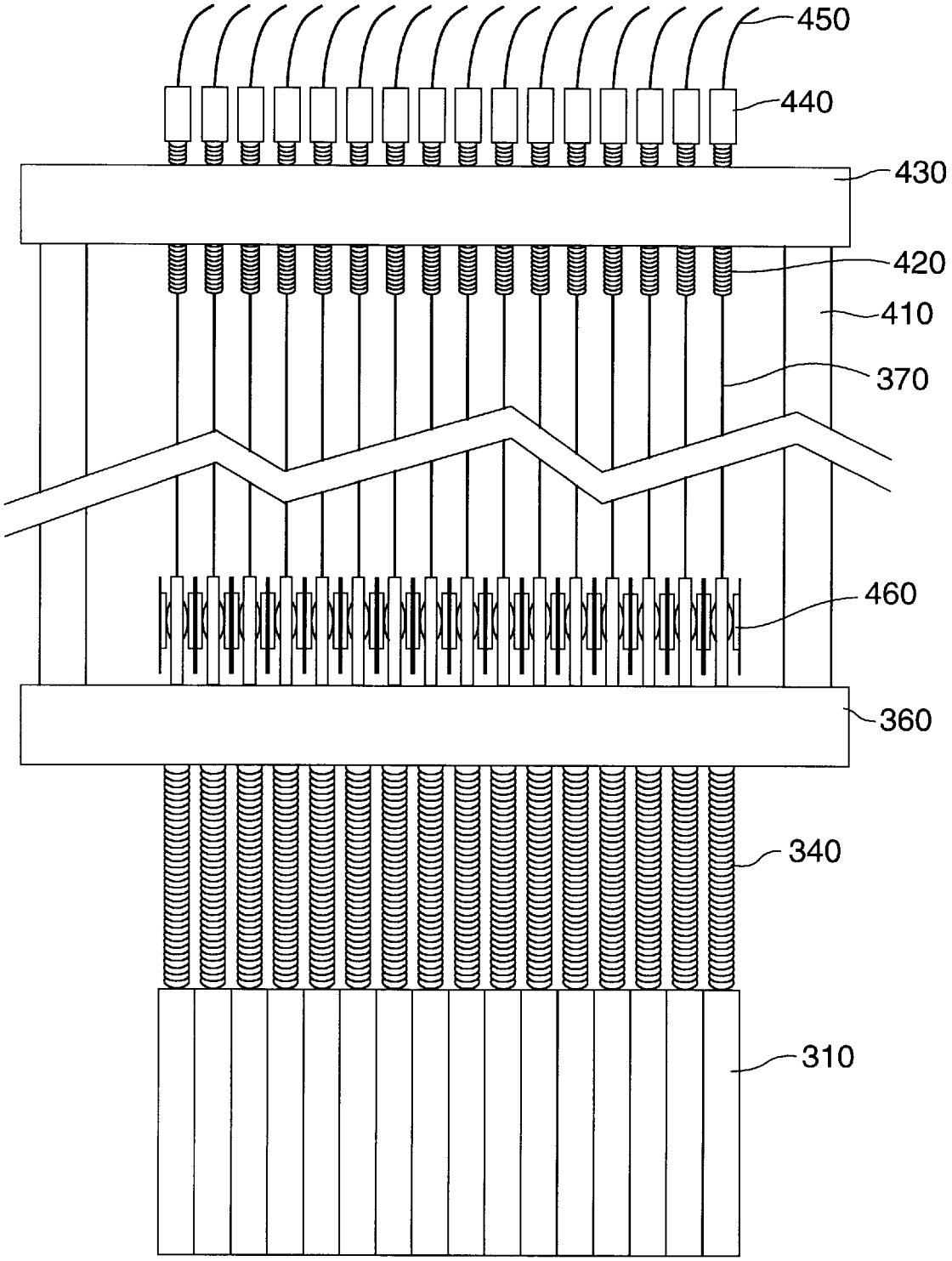
FIG. 4 illustrates a side view of one embodiment of the piston positioning mechanism of the present invention, utilizing nickel-titanium wires for piston displacement.

FIG. 3 illustrates a preferred embodiment of the pistons utilized in this embodiment of the equalizer setup 170 (see FIG. 1) for mask equalization generation (i.e. making the pattern in the mask). In this embodiment the piston head 310 is constructed using metallic square rods 310, where a certain portion of the length is machined into a cylindrical shaft 320. A small hole 330 is drilled into the shaft 320 for mounting of the nickel-titanium wire 370. (It should be noted that other mounting means may be employed). A compression spring 340 is used to provide a bias force. The inner diameter of the compression spring 340 is such that the shaft 320 can be inserted through the compression spring 340 to form a spring and piston combination 350. A metallic plate 360, with holes drilled in it, is utilized to allow the shaft of the piston 320 through but not the compression spring 340. A nickel-titanium wire is connected to the shaft of the piston through the hole 330.

The positioning process in this particular embodiment of the equalizer setup 170 can be described as follows. Initially an appropriate current is applied through the nickel-titanium wire 370, which produces a contraction in the wire 370. The contraction of the wire 370 will displace the shaft 320 and the head 310 of the piston relative to the metallic plate 360, which is fixed, and therefore compress the compression spring 340. The displacement depends on the current applied through the wire 370, and can be controlled through a feedback loop. The design for the feedback loop mechanism is described later in FIGS. 4, 5 and 6. Only one piston is shown in this figure in order to assist the understanding of the concept. However, in the practical situation there will be a matrix of multiple pistons (see e.g. FIG. 4) aligned to perform the mask generation task. The size of the matrix will depend on the resolution desired (e.g. 8×8, 16×16).

FIG. 4 illustrates a side view of the piston positioning mechanism contained within this embodiment of the equalizer setup 170 (see FIG. 1). The piston head 310, compression spring 340, metallic plate 360, and the nickel-titanium wire 370 have been described previously and therefore will not be discussed in detail here. A metallic plate 360 and an insulating plate 430 are supported by stainless steel rods 410. The wires 370 are held by screws 420 that are mounted through the insulating plate 430. The appropriate tension on the wires 370 can be obtained by adjusting the screws. A conducting connector 440 and conducting lead 450 provides electrical connection for the screws 420 and nickel-titanium wires 370, and allow for current transfer in order to adjust the length of the wires. A heating circuit (not shown) is utilized to provide current, thereby heating the wires to lengthen or contract them. In the heating circuit, which will be described in more detail in FIG. 6, the metallic plate 360 is set to ground level, each wire is heated through its individual connector and the heating circuit. The actuation of piston head 310 is realized through potentiometers 460 by which the height or position of the pistons 310 can be sensed and used through a feedback loop.

FIG. 5 shows the details of the actuation potentiometer 460 in FIG. 4. In FIG. 5-1, two insulating plates 510 are coated with conducting plastic layers 520 with known resistance and are positioned in parallel to the piston shaft 320. Electrical connections to the circuit are provided through the wires 530. Two flat spring brushes 540 are mounted near the tip of the piston shaft 320 to provide electrical contact with the conducting plastic layers 520. These two flat spring brushes 540 are electrically connected and physically held in position by a metallic ring 550. The metallic ring surrounds the piston shaft 320 but is electrically insulated from it by a ceramic ring 560.

The effective circuit of the potentiometer of FIG. 5-1 is shown in FIG. 5-2: Two identical resistors R are connected by the flat spring brushes 540 (see FIG. 5.1) represented in FIG. 5-2 by the arrow. As the position of the flat spring brushes 540 changes, the resistance across point A and point B changes accordingly. The change of resistance can then be detected by the computer and used in the feed back loop circuit (not shown) for piston position control.

Figure 6:
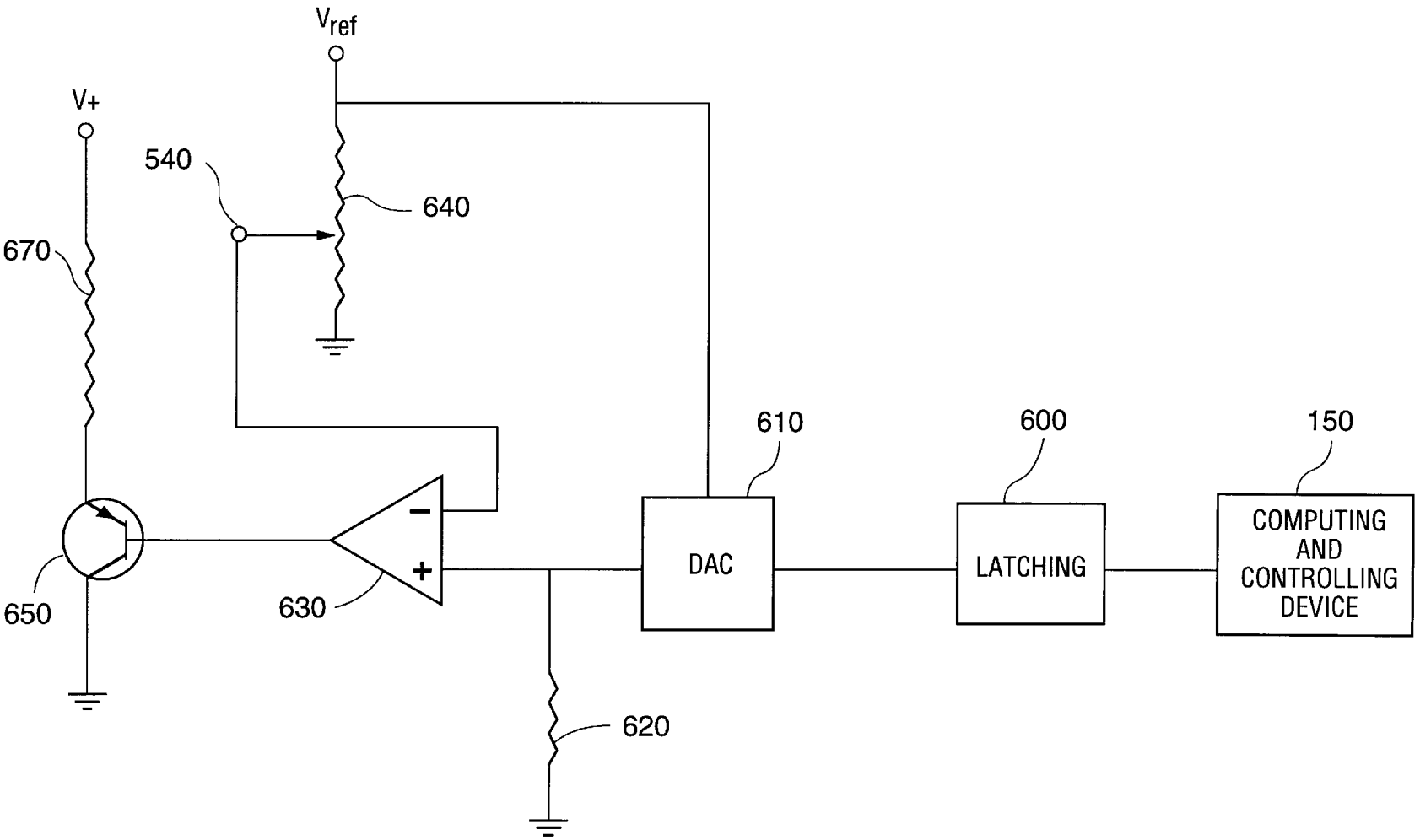
FIG. 6 illustrates a preferred embodiment of the piston actuation circuit utilized in one embodiment of the equalizer setup.
Figure 7:
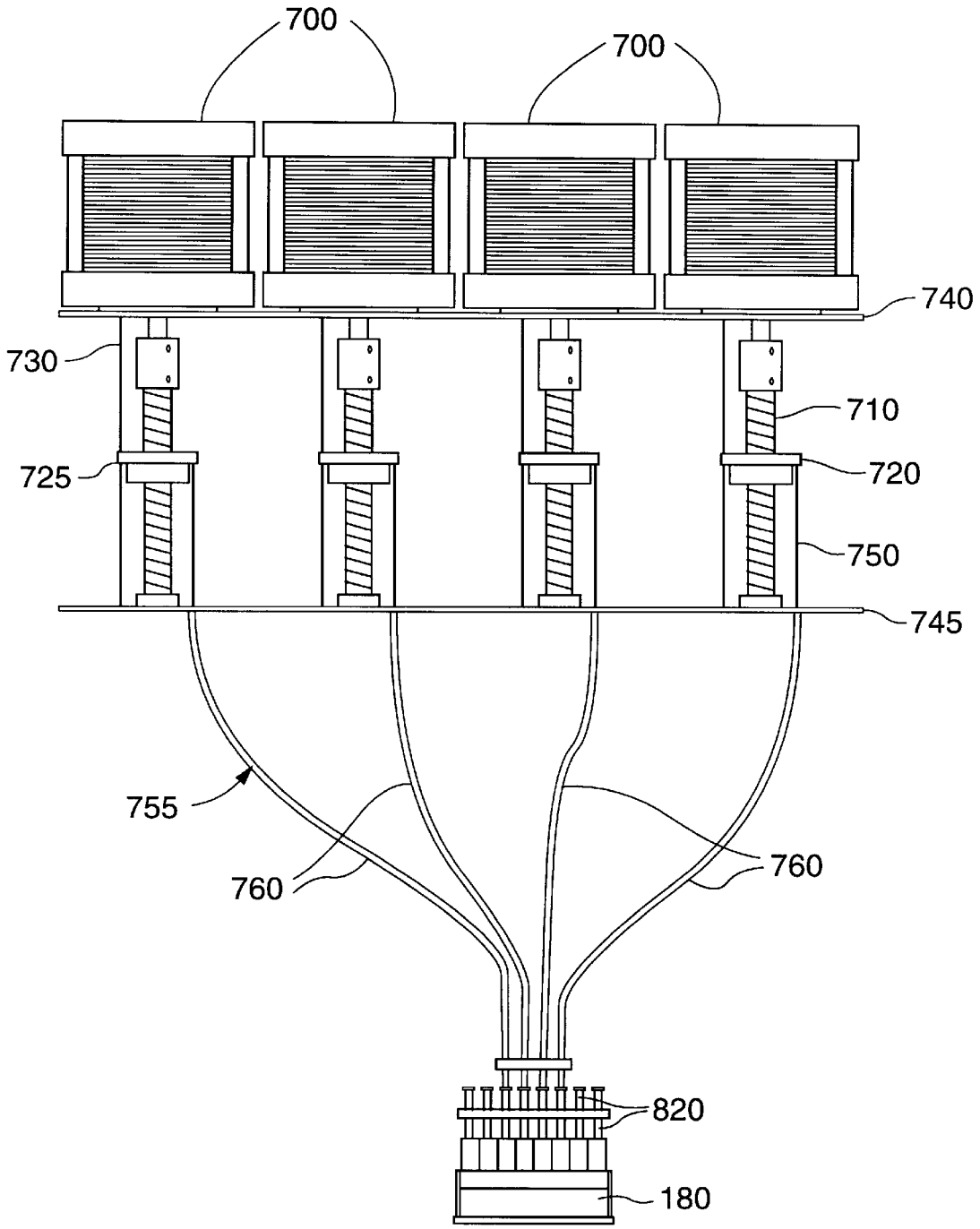
FIG. 7 illustrates an alternative embodiment of the piston actuation mechanism of the equalizer setup, utilizing a stepper motor assembly.

FIG. 6 shows the details of the piston actuation circuit. The circuit for only one piston is shown and it is understood that the circuit for the other pistons are similar. Although the present invention is described using the following actuation circuit, it should be noted that other well known circuits for performing the same functions can also be utilized.

In this circuit, the potentiometer is depicted schematically as element 640 in FIG. 6; it is the same potentiometer that was shown mounted on the top of the piston shaft 320 in FIG. 5. The resistor 670 represents the resistance of the nickel-titanium wire 370 in FIG. 4. After the computing and controlling device 150 (see FIG. 1) calculates and converts the desired attenuator thickness or piston position into a corresponding signal, it is then transferred to a digital latching element 600 and a DAC interface 610. The purpose of positioning the digital latching element 600 before the DAC interface 610 is to maintain the digital signal in place so that the converted analog signal is kept constant. The analog output current (not shown) is converted into a voltage signal (not shown) by the converting resistor 620 and is connected to the non-inverting input (+) of the operational amplifier 630. The non-inverting input (+) of the operational amplifier 630 is compared with the voltage from the piston potentiometer 640 in order to perform feed back loop operations.

The piston potentiometer 640 and the reference voltage $V_{ref}$ are used for calibration in order to get a desired range of piston positions for a certain DAC interface 610 output voltage range. During the piston positioning operation, if the output voltage from the potentiometer 640 is different from the non-inverting input voltage of the operational amplifier 630, the operational amplifier 630 will drive the power transistor 650 to increase or reduce the current through the nickel-titanium wire represented in FIG. 6 as resistor 670, such that the resultant nickel-titanium wire length or corresponding piston position provides the desired output voltage from the potentiometer 640.

Piston Displacement Using Stepper Motors

Figure 8:
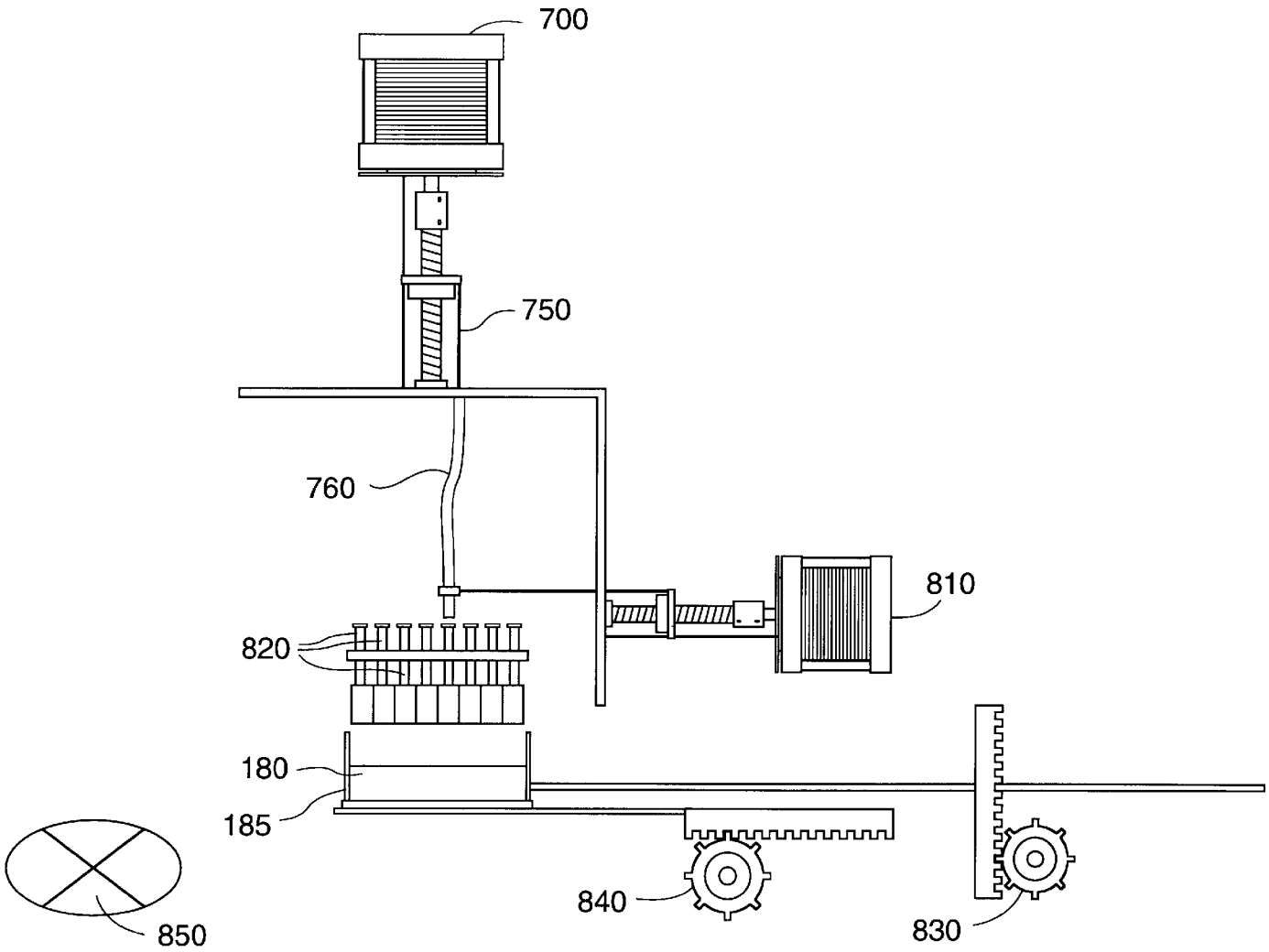
FIG. 8 illustrates the X-axis, Z-axis and X'-axis stepper motor arrangements contemplated in a preferred embodiment of the present invention.

In an alternative and preferred embodiment of the equalizer setup 170, illustrated in FIGS. 7–8, a series of stepper motors are employed for accurate positioning of the pistons, which in this embodiment comprise an array of stainless steel rods approximately 2 mm in diameter. In this embodiment, the attenuator thickness determinations are converted by the computer 150 (FIG. 1) into the appropriate number of steps for each stepper motor, and transferred to a motor controller for the piston position control step 250 (FIG. 2). The mask generation step 260 is then accomplished by pushing the pistons the required depth into the attenuating material, using the stepper motor assembly.

The main challenge in accurately positioning the pistons is their small size and large numbers, particularly since they need to be packed side-by-side into an 8×8 or 16×16 array. Another significant challenge is the fact that the pistons need to be individually controlled in a relatively short time period (i.e. a few seconds). Stepper motors present another useful alternative for controlling the piston displacement, but their size can be a practical limitation. The preferred embodiment of the present invention overcomes this obstacle, by utilizing small flexible shafts attached to the motor assemblies, which can be curved and brought together to form a line of conduits adjacent to each other for positioning the pistons. Thus, in the preferred embodiment the stepper motors can be mounted away from the pistons, and the conduits containing the flexible shafts can be packed into the small required space.

A diagram of this preferred embodiment is shown in FIG. 7, which illustrates the concept with a series of four stepper motors. Of course, it is contemplated that any number of stepper motors can be utilized to provide actuation for virtually any size array, whether 8×8 or 16×16 or larger. As described in more detail below, the preferred embodiment further contemplates that the matrix of active pistons will be supplemented by additional surrounding pistons, i.e. an 8×8 array of active pistons will be incorporated into the center of a 12×12 array, to assist in reshaping the mask. Moreover, while the preferred embodiment described below utilizes a single row of actuators moved sequentially over the array of pistons, the apparatus of the present invention can also be easily adapted to actuate more than one row at one time, or alternatively each piston in the array simultaneously, if desired.

As shown in FIG. 7, each piston stepper motor 700 is attached to a lead screw 710 and a nut 720, which converts the rotational motion of the motor into a linear motion. The nut 720 is prevented from rotating with the lead screw 710 by an alignment rod 730, which goes through a hole 725 in the nut 720 and is attached to an upper plate 740 and a lower plate 745. In this embodiment, as the motor 700 rotates in different directions, the nut 720 travels up or down. The nut 720 is then connected to a flexible shaft 750, which travels inside an extension spring 755 used as a conduit 760. The conduits 760 from different motors 700 are curved and brought to a point to form a line of conduits adjacent to each other. With this design the piston stepper motors 700 can be mounted away from the pistons, and the conduits 760 can be packed into the small required space. The flexible shafts 750 are then used to simultaneously push one row of pistons into the equalization mask 180.

Stepper motors are relatively easy to control and very accurate for positioning purposes. However, one potential limitation is that they are free running systems and do not use encoders for feedback of position. Unfortunately, the use of encoders in the small available space would significantly complicate the design of the system. This potential limitation is overcome in the preferred embodiment by reestablishing the zero position for each piston stepper motor 700 in each cycle of operation, using a solid stop (not shown) on the lead screw 710 of each motor 700. For example, a motor that requires two hundred steps to position a piston 820 will be moved by two hundred steps in the positive direction from the zero location (the nut 720 against the solid stop). It will then be moved by two hundred steps in the negative direction. In the case where there are no lost steps, the shaft of the motor will be at the zero location (the nut 720 against the solid stop).

However, if the piston stepper motor 700 experiences excessive torque in the process, it can lose several steps during the cycle. The zero position can be easily reestablished by always moving the shaft by a predetermined number of steps (e.g. ten steps) more in the negative direction than positive direction. In the above example, the piston stepper motor 700 will be stepped two hundred and ten steps in the negative direction and then the zero position will be reset automatically. This will prevent any error up to ten steps from being carried to the next cycle. It is contemplated that the number of steps required for offset can be easily determined from initial experience with a specific equalizer system according to the present invention.

Referring now to FIG. 8, in a further embodiment the conduits 760 can be fixed between two small aluminum plates (not shown), which are attached to an X-axis stepper motor 810 used to move the line of conduits 760 over the pistons 820. The flexible shafts 750 are moved through the conduits 760 and used as actuators to push the line of square pistons 820 through the equalization mask 180. For example, in an 8×8 matrix of pistons, eight piston stepper motors are used to control the depth of eight pistons simultaneously, while a ninth stepper motor (the X-axis motor) is used to move the line of conduits over to the next eight pistons. The process will be repeated until all of the 64 pistons are properly positioned.

An alternative and preferred embodiment of the mask positioning means 270 (FIG. 2) is also contemplated for the stepper motor assembly described above, in order to separate the equalization mask 180 from the pistons 820 and position it in the x-ray beam. In the preferred embodiment a separate stepping motor 830 (the Z-axis motor) is used to separate the equalization mask 180 from the pistons 820, while another stepping motor 840 (the X'-axis motor) positions the mask 180 in the x-ray beam (850). In one embodiment, the exact positioning of the mask 180 can be predetermined using a solid stop (not shown), that will limit the motion of the mask container by the X'-axis motor 840. In a further embodiment, a solid stop can also be used for the Z-axis motor 830 to reset the zero position for each cycle, as described above for the piston stepper motor 700. There are numerous, commercially-available Z-X-axis tables that can be used for fast positioning of the equalization mask 180 from the pistons 820 to a predetermined position in the x-ray beam. For example, one preferred embodiment of the Z-X-axis table would be the Unislide Assembly, manufactured by Velmex in East Bloomfield, N.Y.

After the equalized images are acquired, the equalization mask 180 will be moved back into its original position and prepared for the next mask generation. The X'-axis motor 840 and the Z-axis motor 830 are used to move the mask and its container under the pistons 820 again. In order to make the mask reusable, the mask thickness must be readjusted to a known uniform thickness. In a preferred embodiment of the stepper motor apparatus described above, this is accomplished by pushing the mask 180 against the pistons 820 using the Z-axis motor 830.

It is contemplated that the pistons 820 and the container 185 holding the attenuating mask 180 will form a fairly tight fit, as depicted in the diagram in FIG. 8. In addition, as noted above, in the preferred embodiment the active array of pistons will be supplemented by additional surrounding pistons. With this design the excess attenuating material can be pushed to the periphery matrix during the mask generation step 260 (FIG. 2), and then easily reshaped to a uniform thickness. For example, in the case of an 8×8 matrix of active pistons, a 12×12 array of pistons will be used, with the sixty-four pistons at the center of the matrix used to form the mask. The function of the pistons at the periphery is for reshaping the mask to a uniform thickness before generating the next mask. The pistons are moved up to their maximum height when they are pushed against the mask using the Z-axis motor 830. This reshapes the mask to a uniform thickness, since the pistons form a flat surface when they are pushed up to their maximum height. The mask is then lowered so that the pistons are at the middle of their range of motion. At this point the mask and the pistons will be back at their original position and a new mask can be generated.

The following example is provided by way of illustration only to demonstrate certain advantages and preferred embodiments of the present invention, and is by no means intended to limit the invention set forth in the claims.

EXAMPLE

One of the important factors that will determine whether image equalization can successfully be applied in a clinical setting is the time required to generate the masks. Therefore, one of the design criterion is to perform all of the steps, between the acquisition of the initial low dose image and the final equalized image, within a breath hold. In this example, the time required to generate and reshape the mask are estimated using the results from studies with a simple set-up of one piston controlled by a single stepping motor.

A small stepper motor (3×3×3 $cm^3$) connected to a controller (DCB-241 Advanced Micro Systems, Nashua N.H. ) and a computer (IBM 486) was used to determine the required time and force to push a piston into the attenuating mask. The motor assembly was connected as shown in FIG. 7. A special lead screw and a plastic nut (Kerk Motion Products, Hollis, N.H.) were used to minimize frictional forces. The lead screw produces a linear motion of 6.35 mm per revolution. The plastic nut was initially connected to a small rigid rod to test the required time and force. The motor was connected to a 40 volt power supply and controlled by software provided by the manufacturer (DCB-241 Advanced Micro Systems, Nashua N.H.). The rod was positioned on a piston (1.65 mm stainless steel square rod) which was in contact with the attenuating mask.

A total of 400 half steps (HS) are required per revolution of the motor. Assuming that the maximum mask thickness for equalization is 7 mm, a maximum of 441 HS (7/6.35×400=441) would be required for piston positioning. The initial and final velocities of the motor were set to 2400 and 7000 HS/sec, respectively. It was determined that a minimum of 31 HS were required for acceleration and deceleration of the motor. These parameters were adequate for a reproducible positioning of the piston in the attenuating material.

Figure 9:
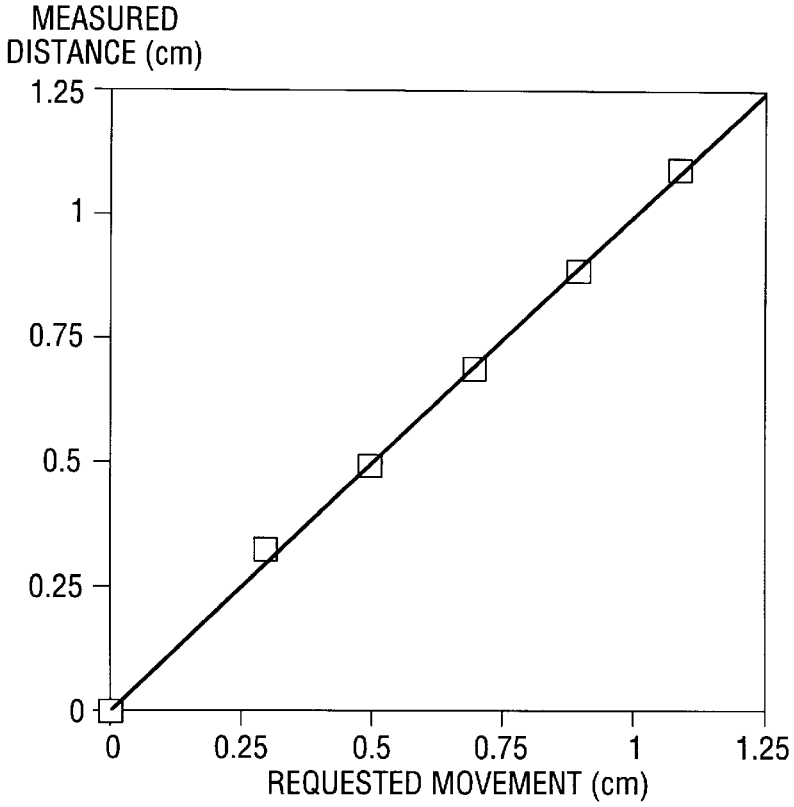
FIG. 9 is a graph depicting the accuracy of piston positioning using a stepper motor in one embodiment of the present invention.

In order to investigate the accuracy of piston positioning, the piston was positioned to different depths in the attenuating material and the depth of the hole generated in the mask was measured using a caliper (see FIG. 9). The measured (M) and requested (R) attenuator thicknesses were related by M=0.99 R+0.01 cm (r=1.00). It was concluded that the accuracy of piston placement (6.35 mm/400=0.016 mm) was better than the caliper measurements.

Figure 10:
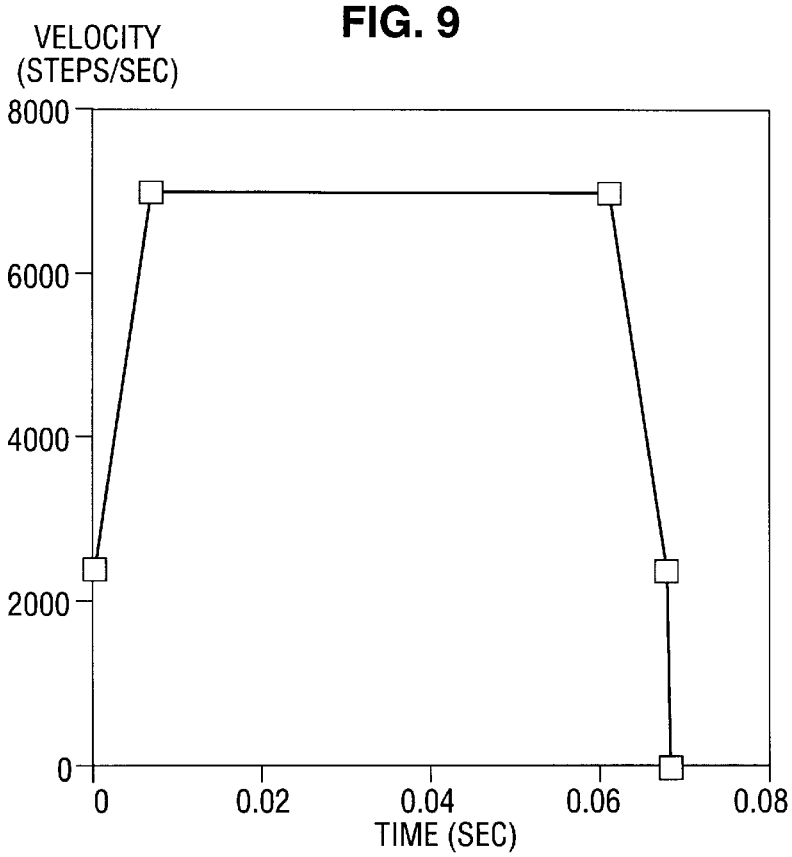
FIG. 10 is a graph depicting the velocity of a stepper motor as a function of time for a 441 half step travel in one embodiment of the present invention.

FIG. 10 shows the velocity of the motor as a function of time for a 441 HS travel. The motor requires time for acceleration and deceleration, and the time cost for acceleration and deceleration were each 7 msec. The remainder of the distance (441−(31+31)=379) was traveled at the final slew velocity (7000 HS/sec). The time cost for the portion of travel at slew velocity was 54 msec (379/7000=0.054). Therefore, the total time cost for the 7 mm travel was 68 msec (7+54+7=68).

In order to test the application of a flexible shaft to push the pistons in the attenuating mask, a stainless steel rod (1.25 mm in diameter) was connected to the plastic nut. An extension spring was used as a conduit and it was curved 3.5 cm away from the point aligned with the shaft of the motor. The flexible shaft was used to reproducibly push the piston in the attenuating mask. Of course, the present invention contemplates an equalization system that will use a number of piston stepper motors to push the pistons in the attenuating mask.

The measured time to push a piston 7 mm into the attenuating material was used to calculate the time required to generate the mask. It was assumed that immediately after a breath hold the pre-exposure image was acquired, and image acquisition, segmentation, thickness calculation and transfer of thickness tables to the motor controller are performed in less than one second. It was also assumed that initially the attenuator had a uniform thickness of 7 mm and the pistons were in contact with it. The first step was to push all of the pistons to the required depth in the attenuating mask. The pistons corresponding to the segments of the image with minimum gray level would be pushed to the maximum depth (7 mm), while those corresponding to the maximum gray level would be pushed to some minimum depth. This would minimize the x-ray tube loading, since the parts of the beam corresponding to the thick parts of the patient would only be attenuated by the minimal thickness of the container holding the attenuating mask.

For the purpose of calculating the time required to generate the mask, it was assumed that all of the pistons would be pushed to the maximum depth. Assuming an 8×8 matrix of active pistons, then, eight stepper motors connected to flexible shafts would be used to push a row of eight pistons simultaneously. The motors require 400 steps/revolution, and the lead screw successfully tested for this purpose generates a linear motion of 6.35 mm/revolution. Therefore, a total of 441 steps were required to push a piston to a depth of 7 mm.

As discussed above, at 40 volts and 7,000 steps/sec, the motor can easily push a piston through the attenuating mask. The total time cost for pushing the pistons 7 mm into the attenuating mask was 68 msec (7+54+7=68). The time cost for moving the motors to their initial position was therefore 136 msec (68+68=136). In order to position all sixty-four pistons (8×8 matrix), eight pistons at a time, the entire process was repeated eight times. Therefore, the total time cost for positioning the 64 pistons was 1088 msec (136×8=1088).

The next step is to translate the flexible shafts of the motors over the next row of pistons using the X-axis motor. The load on the X-axis motor would be relatively small, and a lead screw producing a linear motion of 25.4 mm/revolution was used for this example. Assuming that 2 mm pistons were used and that the motor parameters are kept the same as before, the total time cost for the 2 mm travel would be 9 msec. An 8×8 matrix of active pistons would require seven translations with a total time cost of 63 msec (7×9=63).

At this point all of the pistons would be positioned in the attenuating mask. The next step is to separate the pistons from the attenuating mask using the Z-axis motor. Due to the anticipated load on the Z-axis motor for separation of the mask from the pistons, a lead screw generating 6.35 mm/revolution was used for this purpose. Assuming that a 10 mm translation was necessary to completely separate the mask assembly from the pistons and the motor parameters are the same as before, the total time cost for this step was 95 msec.

The final step before the acquisition of the equalized image is to slide the mask into the predetermined position in the x-ray beam using the X'-axis motor. A lead screw producing a linear translation of 25.4 mm/revolution was used for this example. Assuming that a 100 mm translation was required to slide the mask in the x-ray beam and the motor parameters are the same as before, the total time cost for this step was calculated to be 229 msec.

The total time between the acquisition of the pre-exposure image and the final equalized images was therefore 2,475 msec (1000+1088+63+95+229=2,475). In order to return the mask to its original position and flatten it for use in generating another mask, a total time cost of 460 msec (229+95+68+68=460) was required. Therefore, assuming that the container holding the mask was in the x-ray beam, the total time required for generating a new mask was 2,935 msec (2,475+460=2,935).

The above time estimations are based on the motor and controller used for this example. It is anticipated that optimization of the motors and the lead screws can further decrease the time required to generate a mask. Moreover, the motor controller used for this example can drive 32 motors simultaneously, which further indicates that it is possible to position more than one row of pistons (e.g. 2 rows in an 8×8 matrix) at a time. This will significantly reduce the total time required to produce a mask at a cost of using more motors. Alternatively, the current controller can be used for a system of up to 29×29 pistons with a total time cost of 2,664 msec (2,475+(21×9)=2,664), assuming that a total of 32 motors are used.

From the above, it is clear that the present invention provides for quick and variable attenuation of different regions of an x-ray signal in order to provide a clearer x-ray image of an object having variable densities. One skilled in the art will recognize that it would be possible to construct the elements of the present invention from a variety of materials and to modify the placement of the components in a variety of ways. While certain preferred embodiments have been described in detail and shown in the accompanying drawings, it will be evident that various further modifications are possible without departing from the scope of the invention as set forth in the following claims.

I claim:

1. An apparatus for attenuating an x-ray beam, comprising:

a. a processor for determining an attenuation pattern;

b. an interface means coupled to said processor;

c. a stepper motor assembly coupled to said interface means;

d. an array of pistons coupled to said stepper motor assembly, such that said stepper motor assembly actuates said array of pistons to create said attenuation pattern; and e. an equalization mask, wherein said array of pistons generate an equalization pattern in said equalization mask corresponding to said attenuation pattern.

2. The apparatus of claim 1, wherein said stepper motor assembly is coupled to said array of pistons by means of conduits.

3. The apparatus of claim 2, wherein said conduits comprise flexible shafts disposed inside of extension springs.

4. The apparatus of claim 1, wherein said interface means comprises a motor controller.

5. The apparatus of claim 1, wherein said stepper motor assembly comprises a series of piston stepper motors.

6. The apparatus of claim 5, wherein said series of piston stepper motors actuate a single row of pistons in said array of pistons at one time, and are moved sequentially between said rows by means of a separate X-axis stepper motor.

7. The apparatus of claim 1, further comprising a positioning system for supporting said equalization mask while said equalization pattern is being generated, and for manipulating said mask between a position outside an x-ray beam path and a position within said x-ray beam path.

8. The apparatus of claim 7, wherein said positioning system comprises a Z-axis stepper motor and an X'-axis stepper motor.

9. The apparatus of claim 1, wherein said array of pistons further comprises a matrix of active pistons surrounded by additional pistons for reshaping the mask to a uniform thickness.

10. The apparatus of claim 1, wherein said equalization mask is comprised of binding material and a rare earth metal.

11. The apparatus of claim 10, wherein said binding material is silicone rubber and said rare earth metal is cerium oxide.

12. An apparatus for attenuating an x-ray beam, comprising a. an x-ray source for projecting an x-ray beam in a path through an object;

b. an x-ray detector for detecting said x-ray beam;

c. a processor for processing data from an initial x-ray scan and locating different regions of exposure;

d. a plurality of stepper motors coupled through an interface means to said processor;

e. an array of pistons coupled to said plurality of stepper motors, such that the rotational motion of said stepper motors is converted to linear displacement of said array of pistons corresponding to said different regions of exposure located in the initial scan; and f. an equalization mask wherein said mask is i) pressed against said pistons to form an equalization pattern, and ii) automatically placed in a path of said x-ray beam between said x-ray source and said object, such that said beam is attenuated.

13. The apparatus of claim 12, wherein the rotational motion of said plurality of stepper motors is converted to linear displacement of said pistons by means of a lead screw attached to each stepper motor, a nut threaded on said lead screw and secured by an alignment rod to at least one plate, and a flexible shaft coupled between said nut and one of said pistons.

14. The apparatus of claim 12, further comprising a positioning system for supporting said equalization mask while said equalization pattern is being generated, and for manipulating said mask between a position outside an x-ray beam path and a position within said x-ray beam path.

15. The apparatus of claim 14, wherein said positioning system comprises a Z-axis stepper motor and an X'-axis stepper motor.

16. The apparatus of claim 12, wherein said plurality of stepper motors are coupled to said pistons by means of conduits.

17. The apparatus of claim 16, wherein said conduits comprise flexible shafts disposed inside of extension springs.

18. The apparatus of claim 12, wherein said interface means comprises a motor controller.

19. The apparatus of claim 12, wherein said array of pistons further comprises a matrix of active pistons surrounded by additional pistons for reshaping the mask to a uniform thickness.

20. A method of attenuating an x-ray beam, comprising the steps of:

a. providing an x-ray source, an x-ray detector, an object, a processor, a stepper motor assembly coupled to an array of pistons, an interface means coupling said stepper motor assembly to said processor, and a mask;

b. obtaining an initial image of said object using said x-ray source and said x-ray detector;

c. calculating an appropriate attenuation pattern based on said initial image with said processor;

d. forming an appropriate equalization pattern in said mask by i) advancing select pistons among said array of pistons with said stepper motor assembly under control of said processor, and ii) pressing said array of pistons against said mask in order to create said equalization pattern in said mask; and e. placing said mask in a path of said x-ray beam between the x-ray source and the patient, such that the beam is attenuated.

21. The method of claim 20, wherein said step of calculating said attenuation pattern further comprises the steps of:

i. locating different regions of exposure in said initial image; and ii. calculating thicknesses of said mask required to attenuate said different regions of exposure.

* * * * *

UNITED STATES PATENT AND TRADEMARK OFFICE

CERTIFICATE OF CORRECTION

PATENT NO. : 5,881,127
DATED : March 9, 1999
INVENTOR(S) : Sabee Molloi, Ph.D.

It is certified that error appears in the above-identified patent and that said Letters Patent is hereby corrected as shown below:

Title page,
Item [75], Inventors: should be -- Sabee Molloi, Ph.D. only --.

Signed and Sealed this

Tenth Day of September, 2002

*Attest:*

*Attesting Officer*

JAMES E. ROGAN
*Director of the United States Patent and Trademark Office*